US005564553A

United States Patent [19]

Spletzer

[11] Patent Number: 5,564,553

[45] Date of Patent: Oct. 15, 1996

[54] METHOD AND SYSTEM RAPID PIECE HANDLING

[76] Inventor: Barry L. Spletzer, 9504 Arvilla, NE, Albuquerque, N.M. 87111

[21] Appl. No.: 376,206

[22] Filed: Jan. 20, 1995

[51] Int. Cl.[6] ..... B65G 47/26

[52] U.S. Cl. ..... 198/429; 198/431

[58] Field of Search ..... 198/418, 429, 198/431

[56] References Cited

U.S. PATENT DOCUMENTS

| | | | |
|---|---|---|---|
| 4,606,173 | 8/1986 | Meier | 198/431 X |
| 4,732,261 | 3/1988 | Mattern et al. | 198/431 |
| 4,867,626 | 9/1989 | Oberoi | 198/431 X |
| 4,976,344 | 12/1990 | Hultberg | 198/431 X |

*Primary Examiner*—D. Glenn Dayoan
*Attorney, Agent, or Firm*—Brian W. Dodson

[57] ABSTRACT

The advent of high-speed fabric cutters has made necessary the development of automated techniques for the collection and sorting of garment pieces into collated piles of pieces ready for assembly. The present invention enables a new method for such handling and sorting of garment parts, and to apparatus capable of carrying out this new method. The common thread is the application of computer-controlled shuttling bins, capable of picking up a desired piece of fabric and dropping it in collated order for assembly. Such apparatus with appropriate computer control relieves the bottleneck now presented by the sorting and collation procedure, thus greatly increasing the overall rate at which garments can be assembled.

67 Claims, 4 Drawing Sheets

METHOD AND SYSTEM RAPID PIECE HANDLING

BACKGROUND

This invention primarily addresses the general problem of application of high-speed cutters to the specialty apparel industry. The essence of the current invention is a method and apparatus designed to rapidly sort garment pieces cut from a single layer of cloth into an order suitable for assembly. The techniques invented, however, can also be applied to non-garment pieces.

The most likely development in high-speed cutters in the apparel industry is large-scale use of laser cutters. The speed of conventional cutters, which include hand cutters and automated blade cutters, ranges from roughly 8–20 inches per second. Economically practical laser cutters make cutting speeds of several hundred inches per second possible, thus offering the potential for a 10 to 20-fold increase in cutting speed relative to current commercial apparatus.

Such an increase in cutting speed, however, must be accompanied by consistent increases in the rate of handling of cut pieces, or the faster cutting speed will be of little benefit. The fastest commercial technique at present involves automated mechanical cutters which operate on a large conveyor which positions a fixed length of fabric under the active area of the cutter. The fabric usually is fed into the system from a large rolled bolt of material. The pieces to be cut from the fabric are laid out in a pattern called a marker, which contains the cutting instructions to produce a number of complete garments of various sizes. A single garment is never divided between two markers.

Garments are always laid out on markers, and the length of a marker is the length over which the cutting pattern is repeated. In current practice a marker generally ranges from 10 to 35 yards long, containing all the pieces for 6 to 15 garments (these are not fundamental limits). The fabric is passed under the active area of the cutter, which then performs the preprogrammed cuts. The information for the cuts is stored in a file much like that used to guide a computer controlled machine tool. The cut garment pieces are then transported (usually by conveyor) to a sorting and collating area, where the garment pieces are separated into piles, each pile containing the parts required to assemble a single garment. These piles are then taken to assembly stations.

The process of assembly is greatly simplified if the garment parts appear in the pile in the order in which they will be assembled. As assembly of the relatively small numbers of garments made using this type of process is usually carried out by manual sewing, proper collation of the pieces before the pile arrives at the manual assembly station greatly improves the throughput of the overall system. This is no simple task, however, as for example the first piece defined by the marker pattern may be the tenth piece to be assembled. In addition, the order of pieces within the marker pattern for different garments will vary, as will the sizes and even the identities of the garments to be assembled. Accordingly, collation of the cut garment pieces is of crucial importance for maximizing the throughput of the garment assembly line.

It would seem that proper design of the marker pattern could greatly simplify the problem of sorting. Unfortunately, the layout of the marker pattern is a highly constrained problem, and ease of piece collation is only one of the constraints. Other constraints include the fact that a fixed number of garments often possessing a range of sizes must fit in the marker, pieces on the marker must be placed so that dye and color variations across the width and length of the fabric are not noticeable in the finished garment, and fabric waste must be minimized. Waste of fabric is especially disagreeable, as this is an industry with massive competition and a small profit margin. Accordingly, the marker patterns are often very convoluted. When combined with the second major constraint listed above, it is not surprising that handling and collation of garment pieces represents a major bottleneck in throughput of garment production. The speed of current cutting technologies is slow enough that these difficult process steps are handled manually with little loss in overall production. However, a massive increase in cutting speed, as is offered by laser cutting, requires a new approach to handling and collation of cut garment pieces.

For the foregoing reasons, there is a need for a new approach to handling and collation of garment pieces cut from a marker pattern which allows operation compatible with cutting speeds vastly greater than those currently used. A further need is for equipment capable of carrying out the abovementioned new approach, yet remaining compatible with a wide variety of garment designs.

SUMMARY

The present invention is directed to a new method for handling and collation of garment parts, and to apparatus capable of carrying out said new method, that satisfies the aforementioned needs of the garment industry. A number of possible implementations which will be covered in the detailed description of the drawings and the claims. The common thread is the application of computer-controlled shuttling bins, capable of picking up a desired piece of fabric and dropping it in collated order for assembly. Numerous embodiments and other features, aspects, and advantages of the present invention will become better understood with reference to the following descriptions and appended claims.

BRIEF DESCRIPTION OF THE DRAWINGS

FIG. 2*a* shows the mechanism prior to gripping and lifting a garment piece, and FIG. 2*b* shows the mechanism in the process of transferring the garment piece to a shuttling bin.

FIG. 3*a* shows the mechanism prior to gripping and lifting a garment piece, and FIG. 3*b* shows the mechanism holding the garment piece in place on the shuttling bin.

DESCRIPTION

Given the random ordering of garment pieces on the marker, and the high probability of location conflicts (i.e., pieces near to each other on the marker but far apart in the garment assembly order, or v.v.), the collation process can be difficult. To simplify this process, an intermediate step can be interposed between picking up the garment pieces and producing a collated pile of garment pieces, so that garment pieces can be efficiently combined. The simplest approach to this problem, and the basis for the present invention, is to introduce a series of shuttling bins, one for each garment, which are free to move back and forth across the width of the marker. The shuttling bin, in this simple approach, is oriented substantially perpendicular to the long axis of the fabric, and is long enough to hold all pieces of a given garment side by side without overlap.

An apparatus, which may be mechanical, pneumatic, vacuum, or electrostatic in nature, removes garment pieces from the cut marker as they pass the shuttling bin and transfers them to the shuttling bin. The relative position of the fabric and the shuttling bin is controlled so that each piece of a given garment is transferred to its appropriate place in the assembly sequence along the shuttling bin. Each shuttling bin contains an apparatus, which may be mechanical, pneumatic, vacuum, or electrostatic in nature, which holds garment pieces in place once they are transferred to the shuttling bin.

The simplest approach to the problem is called collation on pickup. In this method, when a given shuttling bin is full, it holds all the garment pieces required to assemble a single garment. The order of the garment pieces along the shuttling bin has the same isomorphic ordering as does the properly collated assembly pile. In a particular implementation, these pieces are then dropped in order from the shuttling bin over a fixed location, thereby forming the collated pile of garment parts, which can then be taken to an assembly station.

Figure 1:
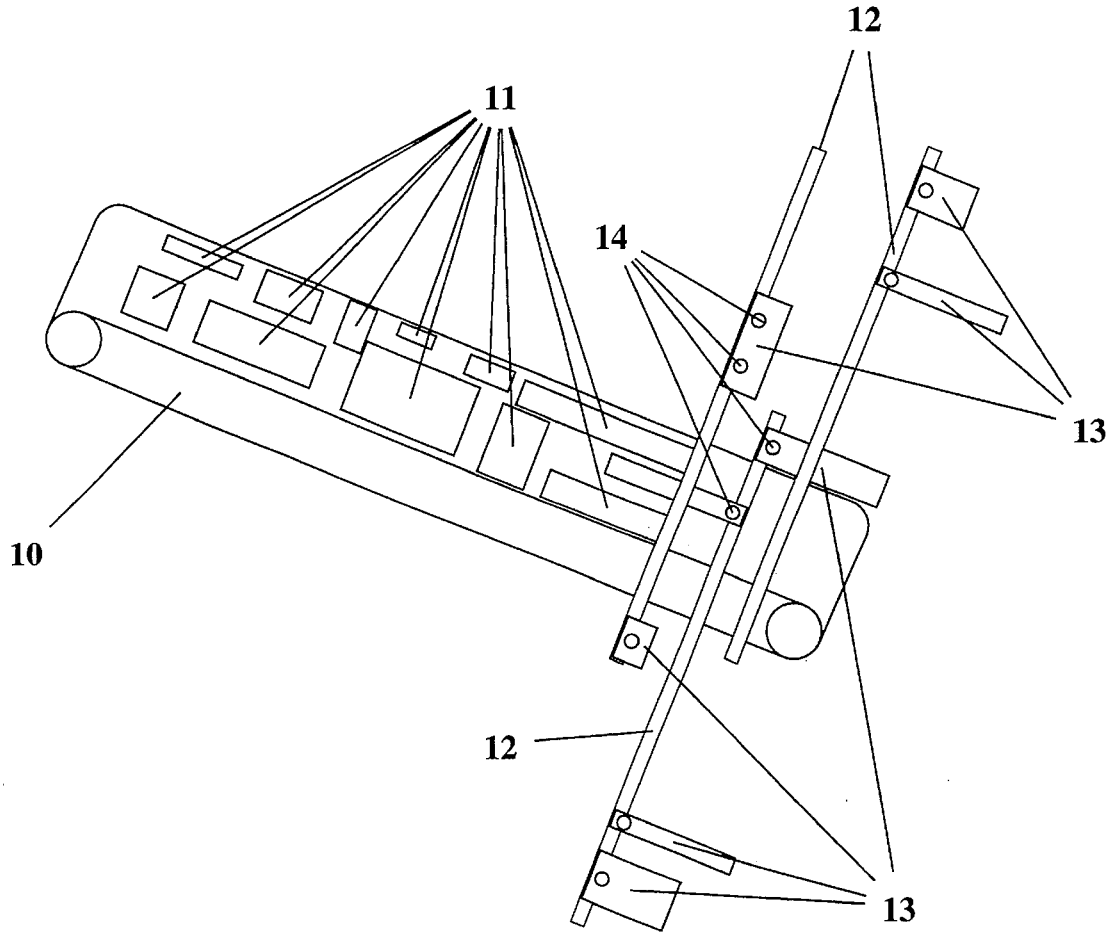
FIG. 1 shows a schematic representation of a simple implementation of the present invention.

The above description is made clearer by reference to FIG. 1. Conveyor belt 10 moves garment pieces 11 from the cutting apparatus (not shown) toward the shuttling bins 12. The shuttling bins have already picked up various pieces 13 through activation of transferring/holding mechanisms 14. As a new garment piece 15 approaches the middle shuttling bin, which is collecting the pieces to the garment of which 15 is an element, the middle shuttling bin slides along its long axis so that the transferring/holding mechanism which corresponds to the proper location for 15 within the garment is in position to transfer 15 to the shuttling bin, a process which has just taken place in the figure. The proper location is predetermined to insure that all respective garment pieces will fit in order on the shuttling bin.

All garment pieces 11 on the conveyor 10 are transferred to their proper places on their respective shuttling bins by this process of sliding the respective shuttling bin into position and activating the appropriate transferring/holding mechanism as the garment piece passes. (Note that it is not necessary for the shuttling bins 12 to move perpendicular to the conveyor belt 10 to carry out the required operations. Floor space considerations may lead one to use a non-perpendicular configuration.) As a result, the garment pieces are separated into sets corresponding to individual garments, said sets having the same isomorphic ordering as the garment assembly piles.

The garment assembly pile (not shown) is formed after the respective shuttling bin holds all pieces of the corresponding garment. The shuttling bin is then moved unidirectionally over a fixed location not on the conveyor belt 10, and the transferring/holding mechanisms 14 are deactivated or reversed as each garment piece passes over the pile. The direction of motion of the shuttling bin in this operation is such that the last garment piece in the garment assembly pile is dropped first. This method yields a pile of garment pieces which retains (at least isomorphically) the ordering of the garment pieces along the length of the shuttling bin. For the assembly in FIG. 1, the result is three complete piles of garment pieces, in the proper order for assembly.

The description above illustrates the basic principles of the present invention. However, this implementation does not provide an efficient general solution to the problem of collation and sorting. For example, if different pieces of the same garment are positioned side by side on the marker, very little time is allowed for the shuttling bin to move between piece pickup positions. If these pieces, despite their proximity on the marker, are located near the beginning and end of the garment assembly pile, requiring that they be picked up in the proper order by a single shuttling bin may prove the limiting factor in overall throughput of the system. Given the present constraints on marker design, such scenarios are likely to be very common. Such placements might be avoided by redesign of the marker, but the present constraints on the marker are severe enough that a piece handling system which introduces yet another strong constraint might well prove to be impractical.

The primary problem in the use of shuttling bins which collate on pickup is that the marker design will often (one is tempted to say usually) cause location conflicts, in which garment pieces belonging to the same garment are very close on the marker, but are separated by many other pieces in the order of assembly. This requires the shuttling bin to be in two locations at virtually the same time, an unreasonable condition. The solution to this problem, which is the second portion of our invention, is to use a split-collating approach toward pickup and collation of properly ordered assembly piles of garment parts.

The basis of the split-collation approach is that there is no fundamental reason that the garment pieces on the shuttling bins need have the same isomorphic ordering as the garment assembly pile. It is simply necessary to know where each garment part is located. Given this information, the garment assembly pile is formed, e.g., by moving the shuttling bin until the last piece in the assembly is over the pile location, dropping the piece, moving the shuttling bin until the next-to-last piece is over the pile location, dropping that piece, and continuing this process until all garment pieces are in a properly ordered garment assembly pile.

How does this avoid location conflicts? Imagine that part 5 and part 17 are side-by-side on the marker. Rather than trying to move the shuttling bin rapidly enough to pick up both pieces in their "proper" locations (proper as defined by the isomorphic garment assembly order), both pieces are picked up at the same time, remaining side-by-side in the shuttling bin. As long as we know where they are, the intermediate order of garment parts in the shuttling bins can be unscrambled in the process of dropping garment parts to form the collated garment assembly pile. This approach can be called collation on drop-off.

Given the degree of flexibility offered by the above approach, in which any order of garment parts in the shuttling bin is acceptable in principle, the question of how a specific intermediate ordering is selected for use must be answered. The primary requirement is that all location conflicts be adequately resolved. Beyond this, however, the position of the garment pieces on the shuttling bin is determined by a tradeoff analysis between the speed and acceleration of the shuttling bin, the length of shuttling bin required for the placement of garment pieces under consideration, the amount of motion required to place each garment piece into an empty location on the shuttling bin, and the amount of motion required to unscramble the intermediate order of garment parts in the shuttling bin. (It may seem odd to include the length of shuttling bin in this calculation, but it is actually a very important factor in determining the total throughput of the system.)

The split collation technique, properly applied, will reduce the additional time required to perform the unscrambling operation. With the ordered shuttling bins described earlier, no pieces are dropped off until all pieces have been picked up, and all pieces must be dropped before the first piece of the next garment is encountered. This is a natural mode of operation for the split collation technique as well. However, it is also possible to drop off pieces into the collation pile before all pieces have been picked up. This will generally decrease both the amount of time spent in post-pickup unscrambling and the total length of shuttling bin which must be used for a given garment. An alternative viewpoint is that dropping off pieces while other pieces are still being picked up will increase the capacity of a system with a given length of shuttling bin.

Determining the optimum solution to such complex pick-up/drop-off problems is extremely difficult. Roughly, the number of solutions for a garment having n pieces is on the order of $2^n!$. To illustrate the difficulty of this calculation, for a 15 piece garment it would take over 1000 years to perform an exhaustive search for the optimum solution given that one could evaluate a million possible solutions per second. An exhaustive search of the possible solutions is thus not a practical option. Instead, constrained optimization techniques will be brought to bear to determine a reasonably efficient solution. To avoid the problem of getting caught in a local minimum of state space, use of hill-climbing techniques or genetic algorithms will be required to obtain a solution having overall efficiency close to that of the (unknown) global minimum.

Various types of devices to grip, transfer, and hold the garment pieces in a shuttling bin are required to make this invention functional. As the details of such mechanisms are well-known to one skilled in the art, only schematic representations of their application to the present invention will be illustrated.

One approach toward the transfer of garment pieces from the conveyor means to a shuttling bin is a set of linear gangs of mechanical picking arms, one gang for each shuttling bin, which pick up the fabric of the garment piece and move it to a position where a mechanism on the shuttling arm can take hold of the garment piece. A particularly simple implementation having a wide range of application is a pinch roller system. Such a mechanism is shown in FIG. 2 (only one member of the linear gang of mechanical picking arms is shown for clarity).

Figure 2A:
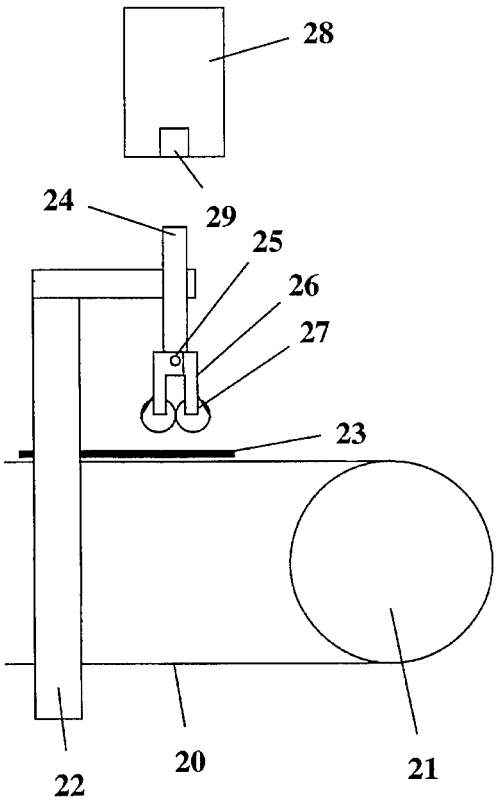
FIGS. 2*a* and 2*b* show a schematic representation of a pinch roller implementation of a mechanical picking arm.

In FIG. 2*a* appears the mechanism prior to gripping the garment piece 23. Garment piece 23 is being transported on conveyor belt 20 past the fixed mount 22 for the pinch roller assembly 24–27. The pinch roller assembly shown here comprises a vertically mobile mount 24, a pivot 25, pressure-loaded roller arms 26, and powered counterrotating pinch rollers 27. Auxiliary parts are required to move and control the pinch roller assembly, but are not shown here. The conveyor belt 20 passes under a shuttling bin 28 having a series of grippers 29 with which to grip garment pieces which have been transferred to the shuttling bin. Grippers 29 may be mechanical pincers, mechanical clamps, vacuum ports, electrostatic devices, or other devices well-known to one skilled in the art.

To activate the pinch roller assembly, mount 24 is lowered until the pinch rollers 27 make contact with the fabric. The fabric is then drawn up between the two pinch rollers 27 into a position where the grippers 29 on the shuttling bin can take hold of the fabric. At this point, the pressure on the roller arms 26 which allows the pinch rollers to grip and raise the fabric is released so that the fabric is free to move with the shuttling bin (this is not necessary for small garment pieces). Mount 24 is then raised to allow new garment pieces to pass under the pinch rollers 27. The precise order of operations listed above is not fundamental to the present invention, as variations in structure and timing will be obvious to one well-versed in the art. Note also that the pinch roller assembly may be replaced by a wide range of mechanisms obvious to one skilled in the art without introducing any fundamental difference in the system being described.

Figure 2B:
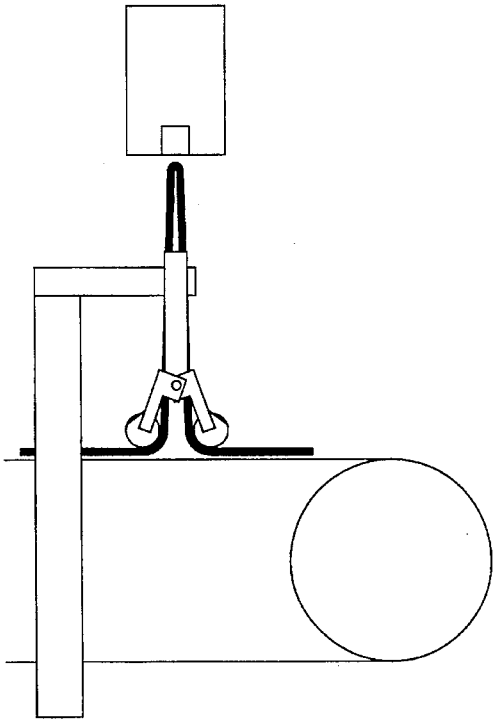

FIG. 2*b* shows the mechanism immediately following gripping the garment piece 23 and transferring it to the shuttling bin 28. The garment piece 23 is held in place on the shuttling bin by gripper 29. The roller arms 26 have just opened to allow the garment piece to mechanical picking arm assembly to return to its original position. A significant question concerns interference of the mechanical picking arm assembly with the transferred garment piece. Ideally the shuttling bin is high enough above the conveyor belt that the garment pieces it holds following transfer do not touch the conveyor belt. However, it is still necessary to design the mechanical picking arm assembly and its mount so that it does not touch the garment pieces as the shuttling bin moves back and forth. This is a design problem easy to solve, but its solution will depend on the exact implementation and design limits of the overall apparatus.

Another approach to the use of pinch roller systems is to mount a linear gang of such pinch rollers on each shuttling bin. This has the disadvantage that more pinch rollers, with their concomitant control systems, will generally be required, but offers the advantage that the same mechanism used to pick up the fabric can be used to hold the garment pieces in place on the shuttling bin. Such a design, of course, can also be used with the types of grippers listed in the discussion of FIG. 2, but this represents a duplication of function without obvious advantage.

Figure 3A:
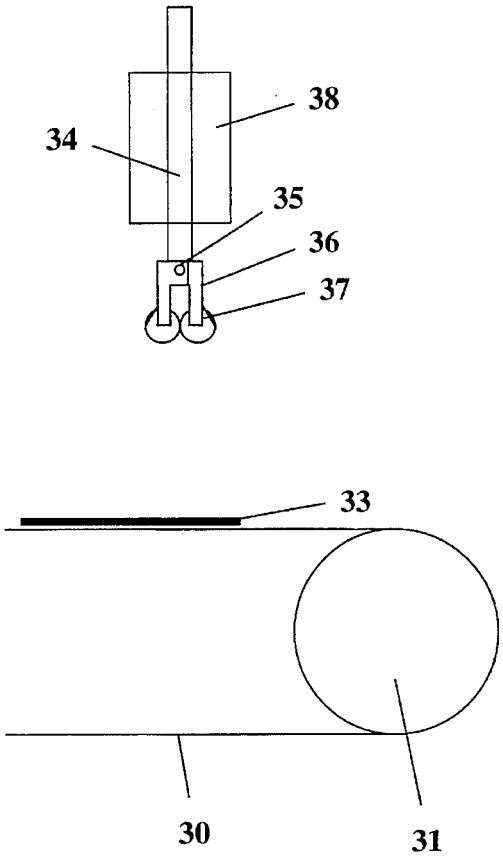
FIGS. 3*a* and 3*b* show a representation of a pinch roller system mounted on the shuttling arm.

FIG. 3 shows a schematic of a mechanical picking arm mounted to a shuttling bin. In FIG. 3*a* the garment piece 33 is being moved into position by the conveyor belt 30. The pinch roller assembly 34–37 works in the same general manner as its analog 24–27 in FIG. 3. However, the mount 32 is connected to the shuttling bin 38 rather than to a fixed point relative to the conveyor 30–31. Another significant difference is that the counterrotating powered pinch rollers 37 can be driven in either of the two possible directions, so that a garment piece can be either picked up, held (no rotation), or ejected from the shuttling bin. A simplification possible in this application is that it is not necessary to have control over the pressure squeezing the pinch rollers 37 together, so that the roller arms 36 can be spring-loaded rather than requiring a pressure control system.

Figure 3B:
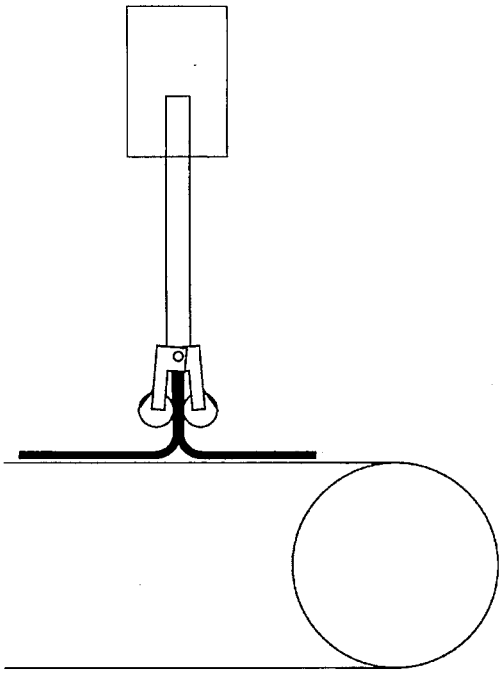

FIG. 3*b* shows the mechanism after it has gripped the cloth of the garment piece 33 and fixed it in place on the shuttling bin 38. Once the fabric is fixed between the pinch rollers, either the mount 34 of the pinch roller system retracts, thus lifting the garment piece from the conveyor, or the rollers continue to move, storing the garment piece in a bin internal to the shuttling bin. In either case, the pinch rollers continue to hold the garment piece, so that they can be used to eject the piece from the shuttling bin at a later time.

Perhaps the most important advantage of this implementation, in which a pinch roller system is mounted directly on the shuttling bin, is that there is no interference with the conveyor as the shuttling bin moves to and fro. Either the garment piece corresponding to a given location is on the conveyor belt, or the appropriate pinch roller system is being used to hold it in place on the shuttling bin above the conveyor belt. This natural lack of mechanical interference is a great advantage in a high-speed sorting system.

The split-collation system has been discussed earlier, where the problem of unscrambling the intermediate order of the garment pieces on the shuttling bin is of primary importance. The possibility of dropping garment pieces before picking up all pieces of a given garment was mentioned as desirable in that some of the unscrambling process takes place as the shuttling bin moves to pick up new garment pieces, meaning that less time (and possibly a shorter shuttling bin) is required to complete the unscrambling process.

Figure 4:
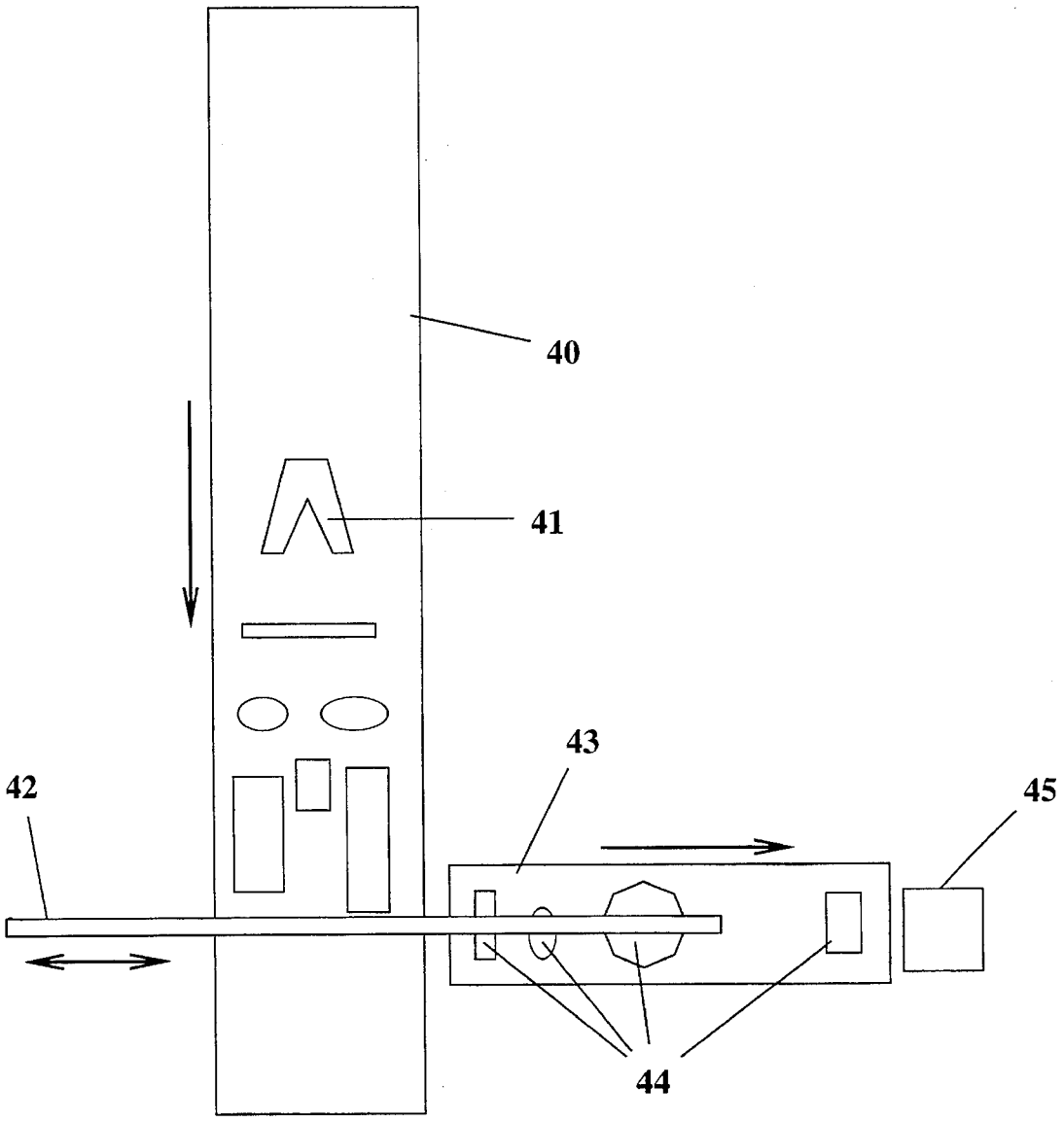
FIG. 4 shows a schematic representation of the use of a collating conveyor.

The implementation shown in FIG. 4 is intended to maximize the number of pieces which can be prematurely dropped off in this manner. Unsorted garment pieces 41 are carried by conveyor 40 toward shuttling bin 42. In line with shuttling bin 42, and adjacent one side of the conveyor 40, is a collating conveyor 43. This is a small conveyor, but with a large enough active length to allow all pieces of a single garment to be placed on it. (The active length of a collating conveyor is that length of the collating conveyor always available on which to drop garment pieces.) In operation, as the shuttling bin moves it carries garment pieces over a stationary collating conveyor. These ordered pieces 44 are dropped from the shuttling bin 42 into locations on the collating conveyor corresponding to their order of assembly. When a complete garment is laid out on the collating conveyor, the collating conveyor starts to move, and the ordered pieces fall off the end of the collating conveyor into a collection tray 45. A complete and ordered garment assembly pile thus forms in the collection tray.

One major disadvantage of this implementation is that an extra conveyor must be used for each active shuttling bin, thus increasing the complexity of the total apparatus and the control system considerably. Another is that the shuttling bins may have to be longer in order to be able to place garment pieces at the far end of the collating conveyor. (The opposite may be true for very complex garments.) However, the great advantage is that most of the unscrambling process can be carried out during the process of selecting garment pieces from the primary conveyor. As the unscrambling process is very time-consuming when all pieces are picked up prior to beginning, the additional throughput offered by the present implementation may justify the higher capital and maintenance costs associated with the collating conveyors.

The use of collating conveyors which are held stationary while the garment pieces are dropped in isomorphic order upon the conveyor causes a number of problems. The length of the collating conveyor is minimal for the above implementation, and control is simple, but the requirement, in the usual case, for longer shuttling bins and the longer motions required to place garment pieces on a stationary collating conveyor in isomorphic order will often result in a general slowing down of the collation process. Such effects make investment in the additional machinery and floor space which are necessary to implement the use of stationary collating conveyors unlikely.

Considerable improvement in the collation process is made possible if the collating conveyor can move between the dropping off of garment pieces. (The schematic representations of all collating conveyor systems are essentially the same as that of the collating conveyor system, as shown in FIG. 4.) The simplest arrangement includes a collating conveyor with an active length sufficient to hold all parts for a given garment and a total length at least twice that value that passes partly under the primary conveyor. The point at which garment pieces are dropped from the shuttling bin can be anywhere along the active length of the collating conveyor. The collating conveyor, however, is free to move between the dropping of pieces from the shuttling bin so that the proper isomorphic location for a given garment piece on the collating conveyor is as close to the primary conveyor as practical. When all garment pieces have been transferred to the collating conveyor, they are dropped from the end of the collating conveyor, thus producing a properly ordered garment assembly pile. (Note that pieces can also be dropped from the collating conveyor before all pieces have been collected. Such a procedure will alter the optimization calculations, and will generally allow the use of shorter shuttling bins and collating conveyors.)

This mode of operation minimizes the time required for the shuttling bin to drop off the garment piece, maximizes the number of garment pieces which can practically be dropped off during the collection process, and reduces the length of the shuttling bin (and hence the complexity of the shuttling bin control system). FIG. 4 is drawn with the collating conveyor oriented parallel to the motion of the shuttling bin; however, any orientation of a moving collating conveyor is acceptable, provided only that an intersection between the axis of motion of the shuttling bin and the axis of motion of the collating conveyor exists to act as the drop-off point for garment pieces.

One problem with the above class of implementations is that the total length of a collating conveyor, in particular a moving collating conveyor, is rather large, thus requiring considerable capital cost and floor space. A system avoiding some of the trade-offs between the stationary and moving collating conveyor systems as described above involves the use of short collating conveyors. A short collating conveyor is based on the same idea as a regular collating conveyor, save that the active length of the short collating conveyor is insufficient to hold all pieces of the garment being constructed. Accordingly, a subset of the pieces of the garment being made is identified as appropriate for collection onto the short collating conveyor. These pieces are assembled on the short collating conveyor in a spatial ordering isomorphic to that which they will have in the garment assembly pile. In the most straightforward implementation, the remainder of the pieces are held on the shuttling bin prior to assembly of the garment assembly pile. (It is also possible to drop some pieces from the short collating conveyor or the shuttling bin before all the pieces have been collected, thereby reducing the length of both the short collating conveyor and the shuttling bin required to collate that garment.) Again, the shuttling bin can be somewhat shorter than in previous implementations described above, particularly if the drop-off point for transfer of garment pieces from the shuttling bin to the short collating conveyor is located near the primary conveyor.

The final step of collation is to combine the pieces on the short collating conveyor with the pieces on the shuttling bin, producing thereby a garment assembly pile having all pieces in the proper order for assembly. This is accomplished by allowing pieces to fall off the end of the short collating conveyor into a collating bin, while dropping pieces from the shuttling bin into the collation bin to fill the holes in the ordered subset of pieces on said conveyor. (Note that this requires that the axis of motion of the short collating conveyor and the axis of motion of the shuttling bin be substantially parallel, and arranged so that transfer of pieces from both the short collating conveyor and the shuttling bin into a common collation bin is possible.) As an example, pieces 1, 2, 3, 5, and 6 may be on the short collating conveyor. While pieces 1, 2, and 3 are falling off the end of the conveyor, the shuttling bin is being positioned so that piece 4, which is held by the shuttling bin, is in position to drop into the collation bin. Once piece 4 drops, then the conveyor drops pieces 5 and 6 into the collation bin. This process allows rapid sorting and collation with a minimum of additional equipment.

One final class of implementations based on the above ideas is intended to obtain a significant portion of the benefits of the collating conveyor systems while minimizing the capital costs and floor space required. This is the heap collating conveyor. A heap is defined as a pile of pieces which is a connected subset of the set of pieces making up a given garment, where the pieces in the heap are in the proper order to add to the garment assembly pile. A connected subset is all pieces between two limits, e.g., pieces 4, 5, 6, 7, and 8. The proper order means that the order 7, 5, 6, 4, 8 is not acceptable, as this is not the order required in the assembly process.

The heap collation process is simple, and works with either stationary or moving heap collating conveyors. Assume that piece 3 is picked up first. This piece will be placed on the heap collating conveyor as the first member of a heap (not the first heap if all garment pieces are to be placed in heaps, as piece 1 has to be on the bottom of the first heap). If piece 17 is picked up next, it is placed in the appropriate spot as the first member of another heap. When piece 4 is picked up, it is placed on top of piece 3, thus forming a two-piece heap. (Note that it is not required that a piece is dropped on a heap as soon as it is transferred to the shuttling bin, but rather such timing decisions will be made differently for each garment in accord with the result of an optimization program. It is intended that heaps will be produced before all pieces are picked up by the shuttling bin, although this is not formally necessary.) Eventually one builds up a complete set of heaps (e.g., 1–2, 3–7, 8–10, 11–16, 17–19) for the garment being collated. The heaps are then dropped off the end of the heap collation conveyor into a collation bin, thus producing the garment assembly pile. It is also possible to drop completed heaps off the end of the heap collating conveyor before all pieces have been collected. This process would alter the results of the optimization process for any given garment.

Note that if a stationary heap collating conveyor is used, the axes of motion of the stationary heap collating conveyor and the shuttling bin must be substantially parallel, and arranged so that garment pieces can drop from the shuttling bin to any position on the active region of the conveyor. If the heap collating conveyor can move, so that the appropriate heap can be placed below the shuttling bin, the size of the shuttling bin can be much smaller, although the size of the heap collating conveyor essentially doubles. This sort of problem has appeared throughout these implementations, and exemplifies the trade-offs required to properly design a rapid piece handling system for a particular application which must fit into a given size and shape of floor space.

A combination of the heap collation and the split-collation shuttling bin approach is also possible. In this case, all pieces are not in the heaps, some still being held by the shuttling bin. They are combined in analogy to the process described earlier, where any holes in the ordering between heaps are filled by pieces dropped from the shuttling bin. (As before, this requires that the axes of motion of the heap collating conveyor and the shuttling bin be substantially parallel and arranged so that garment pieces can drop from the shuttling bin onto either the heaps or directly into the shuttling bin.) It may appear unclear why this procedure offers any benefit. If there are holes in the ordering between heaps (e.g., 1–3, 5–8), this can be cured by dropping piece 4 from the shuttling bin onto the first heap. However, holding certain chosen pieces on the shuttling bin till the last moment has the advantage, at times, of limiting the number of heaps required, and hence reducing both the active length of the heap collating conveyor and the shuttling bin. Completing the heaps at the last minute can be done. However, it is possible that, in the example above, moving piece 4 into position to drop from the shuttling bin into the collation bin while the first heap is being dropped into the collation bin may be faster than moving the shuttling bin so that piece 4 is above heap 1, dropping piece 4 onto heap 1, and then activating the heap collating conveyor to drop heap 1 into the collation bin. This is another approach which may be examined for suitability in the optimization process. Again, both heaps and pieces may be transferred to the collation bin before all pieces required in the assembly of the corresponding garment have been collected from the primary conveyor.

The special features, principles, and attributes of the present invention have been described above. However, the invention is not limited to the specific implementations discussed herein, and is intended to be limited only by the claims appended.

SPECIAL VOCABULARY

Active length of a conveyor—That portion of a conveyor belt available for placement of garment parts.

Garment—Anything comprising pieces of fabric. Garments, for present purposes, need not be clothing.

Garment assembly pile—A pile of all pieces required for assembly of a garment, said pieces being in the proper order for assembly (i.e., first part on top, second part below that, etc.).

Garment marker—The periodic repeat unit for defining the pattern for garment pieces to be cut from a continuous piece of fabric. All pieces of a garment are cut from a single unit of the garment marker.

Isomorphic ordering—Two different spatial orderings of the same set of pieces have isomorphic ordering if the set of relations a $\longleftrightarrow$b (meaning a and b are neighbors) is the same for all elements of the set of pieces. Thus, the ordering of the elements a b c d e is isomorphic to that of making a pile of symbols consisting of a on top of b on top of c on top of d on top of e.

Predetermined pickup point—That point on a conveyor means from which to pick up a garment piece, said point chosen from the possible set of points at which the garment piece may be transferred to an available location on the respective shuttling bin.

Spatial ordering—An ordering of a set of pieces expressed through spatial neighbor relations, i.e., the set of relations a ←→b (meaning a and b are neighbors) for all elements of the set of pieces. This concept is only simple to define in a unique manner for one-dimensional spatial distributions of pieces, such as appear in a garment assembly pile.

Dense—a subset is dense relative to another set if, when the members of the set are in a particular spatial ordering, the subset has the same spatial ordering and has no gaps. I.e., if the set is (1, 2, 3, 4, 5), the subset (1, 2, 3) is dense, but the subset (1, 2, 4) is not.

I claim:

1. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) separating each unique subset of the totality of pieces from said totality of pieces, said separation resulting in a known intermediate spatial ordering of the elements of each said unique subset of the totality of pieces;

c) reordering each said unique subset of the totality of pieces from the known intermediate spatial ordering into an ordering isomorphic to that of said respective individually ordered pile of pieces; and d) forming the respective individually ordered piles of pieces from each said reordered unique subset from the totality of pieces.

2. The method of claim 1, wherein the known intermediate spatial ordering of the elements of each said unique subset of the totality of pieces is isomorphic to that of the respective individually ordered pile of pieces.

3. The method of claim 1, wherein the totality of pieces are pieces cut from a single garment marker.

4. The method of claim 3, wherein each individually ordered pile of pieces forms a garment assembly pile.

5. The method of claim 3, wherein selecting unique subsets of the totality of pieces, each said unique subset of the totality of pieces comprising all pieces belonging to a respective individually ordered pile of pieces, is carried out via design and cutting of a garment marker.

6. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) orienting a respective shuttling bin for each said unique subset of the totality of pieces;

c) transporting said totality of pieces on a primary conveyor means, the location of each individual piece on said primary conveyor means being known;

d) moving each respective shuttling bin so that as the totality of pieces on the primary conveyor means moves, every individual piece of each said unique subset of the totality of pieces passes a known and available location of the respective shuttling bin of said unique subset;

e) conveying each said individual piece of each said unique subset of the totality of pieces to its corresponding known and available location in the respective shuttling bin;

f) holding each said individual piece securely in place in the respective shuttling bin;

g) reordering each said unique subset of the totality of pieces from the known spatial ordering on the respective shuttling bin into an ordering isomorphic to that of the respective individually ordered pile of pieces; and h) forming the respective individually ordered piles of pieces from each said reordered unique subset of the totality of pieces.

7. The method of claim 6, wherein said conveying comprises triggering air pressure jets on said primary conveyor means to throw individual pieces from said conveyor means to the respective shuttling bin.

8. The method of claim 6, wherein said conveying comprises gripping said pieces in a system of gripping means.

9. The method of claim 8, wherein said gripping means comprise a pinch roller system.

10. The method of claim 6, wherein said conveying comprises triggering vacuum jets on the respective shuttling bins to pull individual pieces from said conveyor means.

11. The method of claim 6, wherein said holding comprises triggering vacuum jets on the respective shuttling bins, thereby securing individual pieces in known locations in said respective shuttling bin.

12. The method of claim 6, wherein said holding comprises applying mechanical holding means.

13. The method of claim 12, wherein said applying mechanical holding means comprises use of a pinch roller system.

14. The method of claim 6, wherein said holding comprises applying electrostatic holding means.

15. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) orienting a respective shuttling bin for each said unique subset of the totality of pieces;

c) transporting said totality of pieces on a primary conveyor means, the location of each individual piece on said primary conveyor means being known;

d) moving each respective shuttling bin so that as the totality of pieces on the primary conveyor means moves, every individual piece of each said unique subset of the totality of pieces passes a known and available location of the respective shuttling bin of said unique subset;

e) conveying each said individual piece of each said unique subset of the totality of pieces to its corresponding known and available location in the respective shuttling bin;

f) holding each said individual piece securely in place in the respective shuttling bin;

g) moving the respective shuttling bins and dropping the individual pieces of the respective unique subset of the totality of parts to form a spatial ordering isomorphic to that of the respective individually ordered pile of pieces; and h) forming the respective individually ordered piles of pieces from each said reordered unique subset of the totality of pieces.

16. The method of claim 15, wherein the individual pieces of a unique subset of the totality of parts are dropped from the respective shuttling bin in a order isomorphic to that of the respective individually ordered pile of pieces at a single location, thereby producing the respective individually ordered pile of pieces.

17. The method of claim 16, wherein individual pieces of the respective unique subset of the totality of parts are dropped at a single location prior to transferring all individual pieces of said subset to the respective shuttling bin.

18. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) orienting a respective shuttling bin for each said unique subset of the totality of pieces;

c) placing a respective collating conveyor means for each shuttling bin so that pieces can fall from said respective shuttling bin onto said respective collating conveyor means, said collating conveyor means comprising a primary axis of motion an active length, and an end from which individual pieces can fall, said active length being sufficient to place all individual pieces of the respective unique subset of the totality of parts in predetermined locations thereon;

d) transporting said totality of pieces on a primary conveyor means, the location of each individual piece on said primary conveyor means being known;

e) moving each respective shuttling bin so that as the totality of pieces on the primary conveyor means moves, every individual piece of each said unique subset of the totality of pieces passes a known and available location of the respective shuttling bin of said unique subset;

f) conveying each said individual piece of each said unique subset of the totality of pieces to its corresponding known and available location in the respective shuttling bin;

g) holding each said individual piece securely in place in the respective shuttling bin;

h) moving the respective shuttling bins and dropping the individual pieces of the respective unique subset of the totality of parts onto the respective collating conveyor means, thereby producing a spatial ordering isomorphic to that of the respective individually ordered pile of pieces along the primary axis of motion of said respective collating conveyor means; and i) dropping the spatially ordered pieces along the primary axis of motion from the end of the respective collating conveyor means, thereby forming respective individually ordered piles of pieces from each said unique subset of the totality of pieces.

19. The method of claim 18, further comprising holding said respective collating conveyor means stationary while the individual pieces are dropped at specific locations thereon.

20. The method of claim 18, further comprising moving said respective collating conveyor means between dropping individual pieces at specific locations thereon.

21. The method of claim 18, wherein said dropping of the individual pieces from the end of the respective collating conveyor means is begun prior to transferring all individual pieces of the respective unique subset of the totality of parts to the respective collating conveyor means.

22. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) defining a respective predefined subset of the individual pieces comprising each unique subset of the totality of pieces;

c) orienting a respective shuttling bin for each said unique subset of the totality of pieces;

d) positioning a respective short collating conveyor means for each shuttling bin, said short collating conveyor means comprising a primary axis of motion, an active length, and an end from which individual pieces can fall, said primary axis of motion being oriented substantially parallel to the axis of motion of the respective shuttling bin, said active length being sufficient to place all pieces of said predetermined subset of the individual pieces of the respective unique subset of the totality of parts in a spatial ordering isomorphic to that of the respective individually ordered pile of pieces thereon;

e) transporting said totality of pieces on a primary conveyor means, the location of each individual piece on said primary conveyor means being known;

f) moving each respective shuttling bin so that as the totality of pieces on the primary conveyor means moves, every individual piece of each said unique subset of the totality of pieces passes a known and available location of the respective shuttling bin of said unique subset;

g) conveying each said individual piece of each said unique subset of the totality of pieces to its corresponding known and available location in the respective shuttling bin;

h) holding each said individual piece securely in place in the respective shuttling bin;

i) producing a spatial ordering of the predefined subsets of the individual pieces comprising each unique subset of the totality of pieces isomorphic to that of the corresponding subset of pieces in the respective individually ordered pile of pieces by moving the shuttling bins and dropping elements of the respective predefined subsets onto predefined locations on the respective short collating conveyor means, j) collating the predefined subset of the individual pieces of a unique subset of the totality of pieces located on the respective short collating conveyor means in a spatial ordering isomorphic to that of the corresponding subset of parts in the respective individually ordered pile of pieces and the complement of said predetermined subset with respect to the unique subset, said complement being located in toto on the respective shuttling bin in a spatial ordering isomorphic to that of the corresponding complement in the respective individually ordered pile of pieces, into a single pile of pieces having the spatial ordering of the respective individually ordered pile of pieces.

23. The method of claim 22, further comprising holding said respective short collating conveyor means stationary while the predefined subset of the individual pieces are dropped at predefined locations on the active length of said respective short collating conveyor means.

24. The method of claim 22, further comprising moving said respective short collating conveyor means to allow the respective shuttling bin to drop individual pieces of the predefined subset of the individual pieces at predefined locations on the active length of said short collating conveyor means.

25. The method of claim 22, wherein said collating is carried out by dropping individual pieces off the end of the short collating conveyor means and from the respective shuttling bin in the proper order to create the single pile of parts having the spatial ordering of the respective individually ordered pile of pieces.

26. The method of claim 25; wherein dropping of said individual pieces off the end of the short collating conveyor means onto said single pile of pieces begins prior to transferring all pieces of the predefined subset to the respective short collating conveyor means.

27. The method of claim 25, wherein dropping said individual pieces from the respective shuttling bin onto said single pile of pieces begins prior to transferring all pieces of the complement of the predefined subset to the respective shuttling bin.

28. A method for use in a rapid piece handling system for generating multiple individually ordered piles of pieces from a totality of pieces, comprising:

a) selecting unique subsets of the totality of pieces, each said unique subset of the totality of pieces comprising all pieces belonging to a respective individually ordered pile of pieces;

b) defining heaps, each heap consisting of respective predefined subsets of the individual pieces comprising each unique subset of the totality of pieces, each said heap being dense and isomorphic to the spatial ordering of the corresponding subset of pieces in the respective individually ordered pile of pieces;

c) orienting a respective shuttling bin for each said unique subset of the totality of pieces;

d) positioning a respective heap collating conveyor means for each shuttling bin, said heap collating conveyor means comprising a primary axis of motion, an active length, and an end from which individual pieces can fall, said active length being sufficient to place all respective heaps in a spatial ordering isomorphic to that of the respective individually ordered pile of pieces thereon;

e) transporting said totality of pieces on a primary conveyor means, the location of each individual piece on said primary conveyor means being known;

f) moving each respective shuttling bin so that as the totality of pieces on the primary conveyor means moves, every individual piece of each said unique subset of the totality of pieces passes a known and available location of the respective shuttling bin of said unique subset;

g) conveying each said individual piece of each said unique subset of the totality of pieces to its corresponding known and available location in the respective shuttling bin;

h) holding each said individual piece securely in place in the respective shuttling bin;

i) producing the predefined heaps by moving the shuttling bins and dropping elements of said heaps on the respective heap collating conveyor means such that the spatial ordering of the elements of the heaps is isomorphic to that of those same elements in the respective individually ordered pile of pieces; and j) collating the predefined heaps and the complement of said the elements of said heaps with respect to the unique subset, said complement being located in toto on the respective shuttling bin, into a single pile of pieces having the spatial ordering of the respective individually ordered pile of pieces.

29. The method of claim 28, wherein all individual pieces of a unique subset of the totality of pieces are contained in heaps.

30. The method of claim 28, wherein said heaps on the respective heap collating conveyor means and the individual pieces held in said respective shuttling bin are combined by dropping heaps off the end of the respective heap collating conveyor means and individual pieces from the respective shuttling bin in the proper order to create a single pile of parts having the spatial ordering of the respective individually ordered pile of pieces.

31. The method of claim 30, wherein individual heaps are dropped from the end of the heap collating conveyor onto the single pile of pieces prior to completion of all said heaps.

32. The method of claim 30, wherein individual pieces are dropped from the shuttling bin onto the single pile of pieces prior to completion of said heaps.

33. An apparatus to form individually ordered piles of garment pieces cut from a marker, comprising:

a) conveyor means for transporting the garment pieces cut from a marker, said conveyor means maintaining the relative positions of said garment pieces in the marker;

b) a set of shuttling bins having a long axis, each capable of independent motion, each respective shuttling bin corresponding to a respective ordered pile of garment pieces, such that the long axis of each respective shuttling bin is long enough to hold all the pieces of the respective ordered pile of garment pieces without overlap;

c) means for controlling the position of each respective shuttling bin such that the relative position of said respective shuttling bin and said conveyor means allows each garment piece belonging to a specific ordered pile of garment pieces to pass the respective shuttling bin at a predetermined pickup point;

d) means for transferring garment pieces belonging to a specific ordered pile of garment pieces from the conveyor means to the respective shuttling bin as said garment pieces pass said respective shuttling bin at the predetermined pickup point;

e) means for holding garment pieces belonging to a specific ordered pile of garment pieces within the respective shuttling bin;

f) means for forming a set of respective isomorphically ordered garment pieces comprising dropping individual garment pieces from the respective shuttling bin to form a spatial ordering of garment pieces isomorphic to that of the corresponding individually ordered pile of garment pieces;

g) means for producing an individually ordered pile of garment pieces from each set of respective isomorphically ordered garment pieces; and h) control means to control the timing of operation of the diverse portions of the apparatus.

34. The apparatus of claim 33, wherein said conveyor means advances at a known, but variable velocity.

35. The apparatus of claim 33, wherein said conveyor means advances at a substantially constant velocity.

36. The apparatus of claim 33, wherein each respective shuttling bin is restricted to motion along its long axis.

37. The apparatus of claim 36, wherein each respective shuttling bin is restricted to motions substantially perpendicular to the motion of the garment parts on the conveyor means.

38. The apparatus of claim 33, wherein said means for transferring garment pieces comprises a set of linear gangs of mechanical picking arms, one linear gang for each respective shuttling bin, each linear gang positioned in fixed orientation and position relative to the conveyor means, being spaced along the linear axis so that pieces may be gripped and removed from all predetermined pickup points, lifted from the conveyor means, and positioned on the respective shuttling bin, which has been moved to the correct position by the shuttling bin control system.

39. The apparatus of claim 38, wherein said mechanical picking arms comprise a pinch roller system.

40. The apparatus of claim 33, wherein said means for transferring garment pieces comprises a set of linear gangs of mechanical picking arms, one linear gang mounted on each shuttling bin, being spaced along the linear axis so that garment pieces may be gripped and removed from all predetermined pickup points, lifted from the conveyor means, and positioned on the respective shuttling bin.

41. The apparatus of claim 40, wherein said mechanical picking arms also hold the garment pieces in place on the respective shuttling bins.

42. The apparatus of claim 40, wherein said mechanical picking arms comprise a pinch roller system.

43. The apparatus of claim 40, wherein said mechanical picking arms grip the garment pieces using vacuum ports located on said mechanical picking arms.

44. The apparatus of claim 33, wherein said means for holding garment pieces within a shuttling bin comprises a set of individually controllable vacuum ports arranged along the long axis of said shuttling bin.

45. The apparatus of claim 33, wherein said means for holding garment pieces within a shuttling bin comprises a set of individually controllable mechanical holders arranged along the long axis of said shuttling bin.

46. The apparatus of claim 45, wherein said mechanical holders comprise a pinch roller system.

47. The apparatus of claim 45, wherein said means for holding garment pieces within a shuttling bin comprises a set of individually controllable electrostatic grippers arranged along the long axis of said shuttling bin.

48. The apparatus of claim 33, wherein said means for transferring and holding the garment pieces within a respective shuttling bin further comprises having the control means position the respective shuttling bin so that the individual pieces of a unique subset are picked up and held in a spatial ordering isomorphic to that of the corresponding individually ordered pile of garment pieces.

49. The apparatus of claim 33, wherein said means for producing a set of respective isomorphically ordered garment pieces further comprises having the control means position the respective shuttling bin so that the individual pieces of a unique subset held by said respective shuttling bin can be dropped at a single location in a spatial order isomorphic to that of the respective individually ordered pile of garment pieces.

50. An apparatus to form individually ordered piles of garment pieces cut from a marker, comprising:

a) conveyor means for transporting the garment pieces cut from a marker, said conveyor means maintaining the relative positions of said garment pieces in the marker;

b) a set of shuttling bins having a long axis, each capable of independent motion, each respective shuttling bin corresponding to a respective ordered pile of garment pieces, such that the long axis of each respective shuttling bin is long enough to hold all the pieces of the respective ordered pile of garment pieces without overlap;

c) a set of collating conveyor means, located so that garment pieces may be dropped from said respective shuttling bin onto said collating conveyor means, each collating conveyor means having an end from which garment pieces may fall, an active length sufficient to hold all pieces in a respective unique subset, and a control link with the control means;

d) means for controlling the position of each respective shuttling bin such that the relative position of said respective shuttling bin and said conveyor means allows each garment piece belonging to a specific ordered pile of garment pieces to pass the respective shuttling bin at a predetermined pickup point;

e) means for transferring garment pieces belonging to a specific ordered pile of garment pieces from the conveyor means to the respective shuttling bin as said garment pieces pass said respective shuttling bin at the predetermined pickup point;

f) means for holding garment pieces belonging to a specific ordered pile of garment pieces within the respective shuttling bin;

g) means for controlling the position of each respective shuttling bin and the respective collating conveyor means such that the relative position of said respective shuttling bin and said respective collating conveyor means allows each garment piece belonging to a specific ordered pile of garment pieces to be dropped such that a spatial ordering of garment pieces isomorphic to that of the corresponding individually ordered pile of garment pieces is formed on said respective collating conveyor means;

h) means for producing an individually ordered pile of garment pieces from each set of respective isomorphically ordered garment pieces; and i) control means to control the timing of operation of the diverse portions of the apparatus.

51. The apparatus of claim 50, wherein said respective collating conveyor means is oriented substantially parallel to the respective shuttling bin, and is held stationary while the garment pieces are dropped from the respective shuttling bin at specific locations along the respective collating conveyor means, thereby forming a spatial ordering isomorphic to the respective individually ordered pile of garment pieces.

52. The apparatus of claim 50, wherein said control means issues instructions to said respective collating conveyor means to move between dropping garment pieces from the respective shuttling bin onto the respective collating conveyor means, thereby forming a spatial ordering isomorphic to the respective individually ordered pile of garment pieces.

53. The apparatus of claim 50, wherein said control means issues instructions to drop garment pieces from the end of the respective collating conveyor means, thereby forming the respective individually ordered pile of garment pieces.

54. The apparatus of claim 53, wherein said control means issues instructions to begin dropping said garment pieces from the end of the respective collating conveyor means prior to the placement of all respective garment pieces on said conveyor means.

55. An apparatus to form individually ordered piles of garment pieces cut from a marker, comprising:

a) conveyor means for transporting the garment pieces cut from a marker, said conveyor means maintaining the relative positions of said garment pieces in the marker;

b) a set of shuttling bins having a long axis, each capable of independent motion, each respective shuttling bin corresponding to a respective ordered pile of garment pieces, such that the long axis of each respective shuttling bin is long enough to hold all the pieces of the respective ordered pile of garment pieces without overlap;

c) a set of short collating conveyor means, located so that garment pieces may be dropped from said respective shuttling bin onto said collating conveyor means, each short collating conveyor means having an end from which garment pieces may fall, an active length sufficient to hold all pieces of a predetermined subset of the respective unique subset, a primary axis of motion, and a control link with the control means;

d) means for controlling the position of each respective shuttling bin such that the relative position of said respective shuttling bin and said conveyor means allows each garment piece belonging to a specific ordered pile of garment pieces to pass the respective shuttling bin at a predetermined pickup point;

e) means for transferring garment pieces belonging to a specific ordered pile of garment pieces from the conveyor means to the respective shuttling bin as said garment pieces pass said respective shuttling bin at the predetermined pickup point;

f) means for holding garment pieces belonging to a specific ordered pile of garment pieces within the respective shuttling bin;

g) means for controlling the position of each respective shuttling bin and the respective short collating conveyor means such that the relative position of said respective shuttling bin and said respective short collating conveyor means allows each garment piece belonging to the predetermined subset of a specific ordered pile of garment pieces to be dropped such that a spatial ordering of garment pieces isomorphic to that of the corresponding subset of the individually ordered pile of garment pieces is formed on said respective short collating conveyor means;

h) means for combining the predetermined subset of the individual pieces of a unique subset of the totality of parts located on the respective short collating conveyor means in a spatial ordering isomorphic to that of the corresponding subset of parts in the respective individually ordered pile of pieces, and the complement of said predetermined subset with respect to the unique subset, said complement being located on the respective shuttling bin, into a single pile of parts having the spatial ordering of the respective individually ordered pile of pieces; and i) control means to control the timing of operation of the diverse portions of the apparatus.

56. The apparatus of claim 55, wherein said respective short collating conveyor means is held stationary while said predefined subset of the garment pieces are dropped at specific locations on the active length of said respective short collating conveyor means.

57. The apparatus of claim 55, wherein said respective short collating conveyor means moves to allow the respective shuttling bin to drop garment pieces of said predefined subset at specific locations on the active length of said respective short collating conveyor means.

58. The apparatus of claim 55, whereby said combining takes place through the action of the control means, by dropping pieces off the end of the short collating conveyor means and from the respective shuttling bin onto a single location in the proper order to create a single pile of parts having the spatial ordering of the lo respective individually ordered pile of pieces.

59. The method of claim 58, wherein dropping of said individual pieces off the end of the short collating conveyor means is initiated prior to transferring all pieces of the predefined subset to the respective short collating conveyor means.

60. The method of claim 58, wherein dropping of said individual pieces from the respective shuttling bin is initiated prior to transferring all pieces of the complement of the predefined subset to the respective shuttling bin.

61. An apparatus to form individually ordered piles of garment pieces cut from a marker, comprising:

a) conveyor means for transporting the garment pieces cut from a marker, said conveyor means maintaining the relative positions of said garment pieces in the marker;

b) a set of shuttling bins having a long axis, each capable of independent motion, each respective shuttling bin corresponding to a respective ordered pile of garment pieces, such that the long axis of each respective shuttling bin is long enough to hold all the pieces of the respective ordered pile of garment pieces without overlap;

c) a set of heap collating conveyor means, located so that garment pieces may be dropped from said respective shuttling bin onto said collating conveyor means, each heap collating conveyor means having an end from which garment pieces may fall, an active length sufficient to hold all predetermined heaps of the respective unique subset, a primary axis of motion, and a control link with the control means;

d) means for controlling the position of each respective shuttling bin such that the relative position of said respective shuttling bin and said conveyor means allows each garment piece belonging to a specific ordered pile of garment pieces to pass the respective shuttling bin at a predetermined pickup point;

e) means for transferring garment pieces belonging to a specific ordered pile of garment pieces from the conveyor means to the respective shuttling bin as said garment pieces pass said respective shuttling bin at the predetermined pickup point;

f) means for holding garment pieces belonging to a specific ordered pile of garment pieces within the respective shuttling bin;

g) means for controlling the position of each respective shuttling bin and the respective heap collating conveyor means such that the relative position of said respective shuttling bin and said respective heap collating conveyor means allows each garment piece belonging to a predetermined heap of a specific ordered pile of garment pieces to be dropped such that a spatial ordering of garment pieces isomorphic to that of the corresponding subset of the individually ordered pile of garment pieces is formed on said respective heap collating conveyor means;

h) means for combining the heaps located on the respective short collating conveyor means in a spatial ordering isomorphic to that of the corresponding subset of parts in the respective individually ordered pile of pieces, and the complement of said heaps with respect to the unique subset, said complement being located on the respective shuttling bin, into a single pile of parts having the spatial ordering of the respective individually ordered pile of pieces; and i) control means to control the timing of operation of the diverse portions of the apparatus.

62. The apparatus of claim 61, wherein the control means causes the respective shuttling bin to drop predetermined garment pieces upon specific heaps located on the active length of said respective heap collating conveyor means in a spatial ordering isomorphic to that of the corresponding subset of garment pieces in the respective individually ordered pile of garment pieces.

63. The apparatus of claim 62, wherein said control means holds the respective heap collating conveyor means stationary during collation of pieces, said respective heap collation conveyor means being so aligned that said predefined subsets of the garment pieces may be dropped from the respective shuttling bin onto specific heaps located on the active length of said respective heap collating conveyor means.

64. The apparatus of claim 62, wherein said control means moves the respective heap collating conveyor means to allow the respective shuttling bin to drop garment pieces of said predefined subset on specific heaps located on the active length of said respective heap collating conveyor means.

65. The apparatus of claim 62, wherein the control means combines the heaps on the respective heap collating conveyor means and the complement of said heaps with respect to the unique subset, said complement being located on the respective shuttling bin, into a single pile of parts having the spatial ordering of the respective individually ordered pile of pieces by dropping heaps off the end of the short collating conveyor means and individual garment pieces from the respective shuttling bin onto a single location in the proper order to create a single pile of pieces having the spatial ordering of the respective individually ordered pile of pieces.

66. The method of claim 65, wherein the control means initiates dropping of said individual heaps off the end of the heap collating conveyor means prior to transferring all pieces of the predefined subsets to the respective heap collating conveyor means.

67. The method of claim 65, wherein the control means initiates dropping of said individual pieces from the respective shuttling bin prior to transferring all pieces of the complement of the predefined subsets to the respective shuttling bin.

* * * * *

UNITED STATES PATENT AND TRADEMARK OFFICE

CERTIFICATE OF CORRECTION

PATENT NO. : 5,564,553

DATED : October 15, 1996

INVENTOR(S) : Barry L. Spletzer

It is certified that error appears in the above-indentified patent and that said Letters Patent is hereby corrected as shown below:

Column 1, Line 2:

This invention was made with Government support under Contract No. DE-AC04-94AL85000 awarded by the United States Department of Energy. The Government has certain rights in the invention.

Signed and Sealed this

Twenty-fifth Day of February, 1997

*Attest:*

Bruce Lehman

BRUCE LEHMAN

*Attesting Officer*

*Commissioner of Patents and Trademarks*